US006068512A

United States Patent [19]

Sugie

[11] Patent Number: 6,068,512

[45] Date of Patent: May 30, 2000

[54] ELECTRICAL CONNECTOR

[75] Inventor: Naoto Sugie, Shizuoka, Japan

[73] Assignee: Yazaki Corporation, Tokyo, Japan

[21] Appl. No.: 09/252,215

[22] Filed: Feb. 18, 1999

[30] Foreign Application Priority Data

Feb. 20, 1998 [JP] Japan ..... 10-039359

[51] Int. Cl.[7] ..... H01R 13/40

[52] U.S. Cl. ..... 439/595

[58] Field of Search ..... 439/595, 752

[56] References Cited

U.S. PATENT DOCUMENTS 5,743,762 4/1998 Takahashi ..... 439/595
5,746,624 5/1998 Ohsumi et al. ..... 439/595

FOREIGN PATENT DOCUMENTS 7-14577 3/1995 Japan .
9-283203 10/1997 Japan .

*Primary Examiner*—Gary F. Paumen

*Attorney, Agent, or Firm*—Sughrue, Mion, Zinn, Macpeak & Seas, PLLC

[57] ABSTRACT

A connector is arranged in a manner that a locking arm 35 is bent and engages with a terminal 26 which is inserted within a terminal storage chamber 23 of a housing 21 thereby to prevent the terminal 26 from being come out from the housing, and the front holder 22 is slid from the front face side of the housing 21 to move from the provisionally locking position to the formally locking position so that the detection plate 46 of the front holder 22 detects the complete insertion of the terminal 26 into the terminal storage chamber 23. An excessive deformation prevention plate 45 is integrally formed at the tip portion side of the detection plate 46 in a manner that, when the front holder 22 locates at the provisionally locking position, the excessive deformation prevention plate covers the outside of the locking arm 35 so as to have a bending deformation space 48 for the locking arm 35 therebetween and prevents the excessive deformation of the locking arm 35 toward the direction for releasing the engagement with the terminal 26. The detection plate 46 has a step portion 50 protruding to the locking arm 35 side relative to the excessive deformation prevention plate 45.

6 Claims, 13 Drawing Sheets

ELECTRICAL CONNECTOR

BACKGROUND OF INVENTION

1. Field of the Invention

The present invention relates to a connector which is arranged by the combination of a housing for storing terminals therein and a front holder for detecting the complete insertion of the terminal to the housing.

2. Related Art

FIGS. 12 and 13 show the conventional connector disclosed in Japanese Patent No. 2666795. This connector is formed by a housing 1 in which a terminal storage chamber 2 is formed and a J fixing member 3 which is attached to the front side of the housing 1

The terminal storage chamber 2 of the housing 1 is arranged to receive therein a terminal 5 connected to an electric wire 4 and is provided at the inner surface thereof with a come-out prevention projection 6. The come-out prevention projection 6 is arranged to engage with the terminal 5 thereby to fix the terminal 5 in a state of being prevented from being come out from the housing. The housing 1 is provided with a cylindrical portion 7 the inner portion of which forms the terminal storage chamber 2. The cylindrical portion 7 extends toward the front portion of the housing 1. The fixing member 3 is attached to the cylindrical portion 7. An elastic arm 7*a* having elasticity is partially formed at the cylindrical portion 7 and the aforesaid come-out prevention projection 6 is formed at the elastic arm 7*a*.

The fixing member 3 is arranged to have a cylindrical-shape with an inner diameter substantially same as the outer diameter of the cylindrical portion 7. The fixing member moves along the cylindrical portion 7 from the front side of the housing 1, and attached to the cylindrical portion 7 in accordance with the sliding operation. As a result of the attachment, the fixing member 3 covers the front face of the terminal storage chamber 2. A pressing convex portion 8 is formed at the fixing member 3 in a manner that the pressing convex portion 8 presses the cylindrical portion 7 from the outer surface thereof so that the come-out prevention projection 6 formed at the cylindrical portion 7 is prevented from being bent outside. As a result, the come-out prevention projection 6 is prevented from being released from the engagement with the terminal 5 thereby to surely fix the terminal 5 to the housing 1. A reference numeral 9 depicts an elastic member provided between the housing 1 and the fixing member 3.

FIG. 12 shows a case where the fixing member 3 is located at a provisionally locking position. When the fixing member slides from this provisionally locking position along the cylindrical portion 7, the fixing member is located at a formally locking position shown in FIG. 13. When the fixing member is located at the formally locking position, since the fixing member 3 is made engaged with the housing 1 to each other by means of a not-shown engaging means, the fixing member 3 is attached to the housing 1.

According to such a structure of the conventional connector, in the case where the terminal 5 is inserted into the terminal storage chamber 2 incompletely, since the come-out prevention projection 6 is pushed up by the terminal 5, the elastic arm 7*a* of the cylindrical portion 7 protrudes outward. Thus, in this state, even if the fixing member 3 is tried to slide from the provisionally locking position to the formally locking position, since the pressing convex portion 8 abuts against the tip portion of the elastic arm 7*a*, the fixing member 3 can not be slid. Thus, the incomplete insertion state of the terminal 5 can be detected. In the case of detaching the terminal 5 from the housing 1, the fixing member 3 is drawn and slid to the provisionally locking position shown in FIG. 12, then the elastic arm 7*a* is bent outside by a drawing jig and the terminal 5 is drawn.

In the conventional connector shown in FIGS. 12 and 13, in the case of detaching the terminal 5 when the fixing member 3 locates at the provisionally locking position, the elastic arm 7*a* of the cylindrical portion 7 is bent outside. However, in this case, if an excessive stress is applied to the elastic arm 7*a*, the elastic arm 7*a* bends to the more extent than needed, there arises a problem that the elastic arm 7*a* may be subjected to the plastic deformation or broken.

SUMMARY OF INVENTION

Accordingly, an object of the present invention is to provide a connector which can detach a terminal through the sliding operation only to one direction without breaking the locking members such as a locking arm engaging with the terminal, thereby to make the thickness of the housing thinner and improve the operability of the connector.

In order to achieve the aforesaid object, according to the present invention, in a connector in which a locking arm is bent and engages with a terminal which is inserted within a terminal storage chamber of a housing thereby to prevent the terminal from being come out from the housing, and the front holder is slid from the front face side of the housing to move from the provisionally locking position to the formally locking position so that the detection plate of the front holder detects the complete insertion of the terminal into the terminal storage chamber, the connector is provided in that an excessive deformation prevention plate is integrally formed at the tip portion side of the detection plate in a manner that, when the front holder locates at the provisionally locking position, the excessive deformation prevention plate covers the outside of the locking arm so as to have a bending deformation space for the locking arm therebetween and prevents the excessive deformation of the locking arm toward the direction for releasing the engagement with the terminal, and that the detection plate has a step portion protruding to the locking arm side relative to the excessive deformation prevention plate.

According to the present invention, when the front holder locates at the provisionally locking position, the excessive deformation prevention plate integrally formed at the tip portion side of the detection plate of the front holder covers the outside of the locking arm in a state that a bending deformation space for the locking arm is formed therebetween. Accordingly, the locking arm can be bent outside and so the locking arm can be released from the engagement state with the terminal due to the bent state thereof. As a result, the terminal can be extracted from the housing. Further, since the excessive deformation prevention plate serves to prevent the excessive deformation of the locking arm, the locking arm is prevented from being bent to the more extent than needed even if an excessive stress is applied to the locking arm, whereby the locking arm is prevented from being subjected to the plastic deformation or breakage.

Since the detection plate has the step portion protruding to the locking arm side relative to the excessive deformation prevention plate, when the front holder is slid to the formally locking position, it can be detected by the presence of the step portion protruding to the locking arm side whether or not the terminal is completely inserted into the housing. That is, since the locking arm does not surely engage with the terminal when the terminal is in an incomplete insertion state such as a semi-insertion state, the locking arm deforms outside, whereby the detection plate protruding by an amount corresponding to the step portion abuts against the locking arm. According to this abutment, the incomplete insertion of the terminal can be detected by the detection plate.

According to such a structure of this invention, since the aforesaid function can be performed by merely sliding the front holder toward the one direction, that is, the horizontal direction, the front holder is not required to be slid toward the vertical direction. Accordingly, the connector can be simplified in its structure for sliding and the thickness thereof can be made smaller. Further, since the front holder is required to be slid only to one direction, the operability of the connector can be improved and the connector can be adapted to the automation system.

According to the present invention, there is provided the detection plate prevents the locking arm from being bent when the front holder locates at the formally locking position.

According to this invention, since the detection plate prevents the locking arm from being bent when the front holder locates at the formally locking position, the locking arm is prevented from being released from the engagement state with the terminal. Accordingly, the terminal can be surely locked.

According to the present invention, an opening window portion is provided between the excessive deformation prevention plate and the detection plate.

According to such a structure, a drawing jig can be inserted within the housing through the opening window portion provided between the excessive deformation prevention plate and the detection plate, so that the locking arm can be easily bent outside. Thus, the terminal can be extracted easily.

According to the present invention, there is provided a surface of the detection plate facing on the opening window portion is formed as a tapered surface.

According to such a structure, the drawing jig can be guided within the housing by sliding the drawing jig along the tapered surface of the detection plate and then the drawing jig can be inserted surely. Further, since the tapered surface of the detection plate picks up the locking arm which is deformed outside due to the incomplete insertion of the terminal, it becomes impossible to forcedly push in the front holder. Accordingly, the front holder can be prevented from being attached to the housing due to the forcedly push-in operation.

DETAILED DESCRIPTION OF PREFERRED EMBODIMENTS

An embodiment of the present invention will be described with reference to FIGS. 1 to 11, 14 and 15.

First Embodiment

Figure 14:
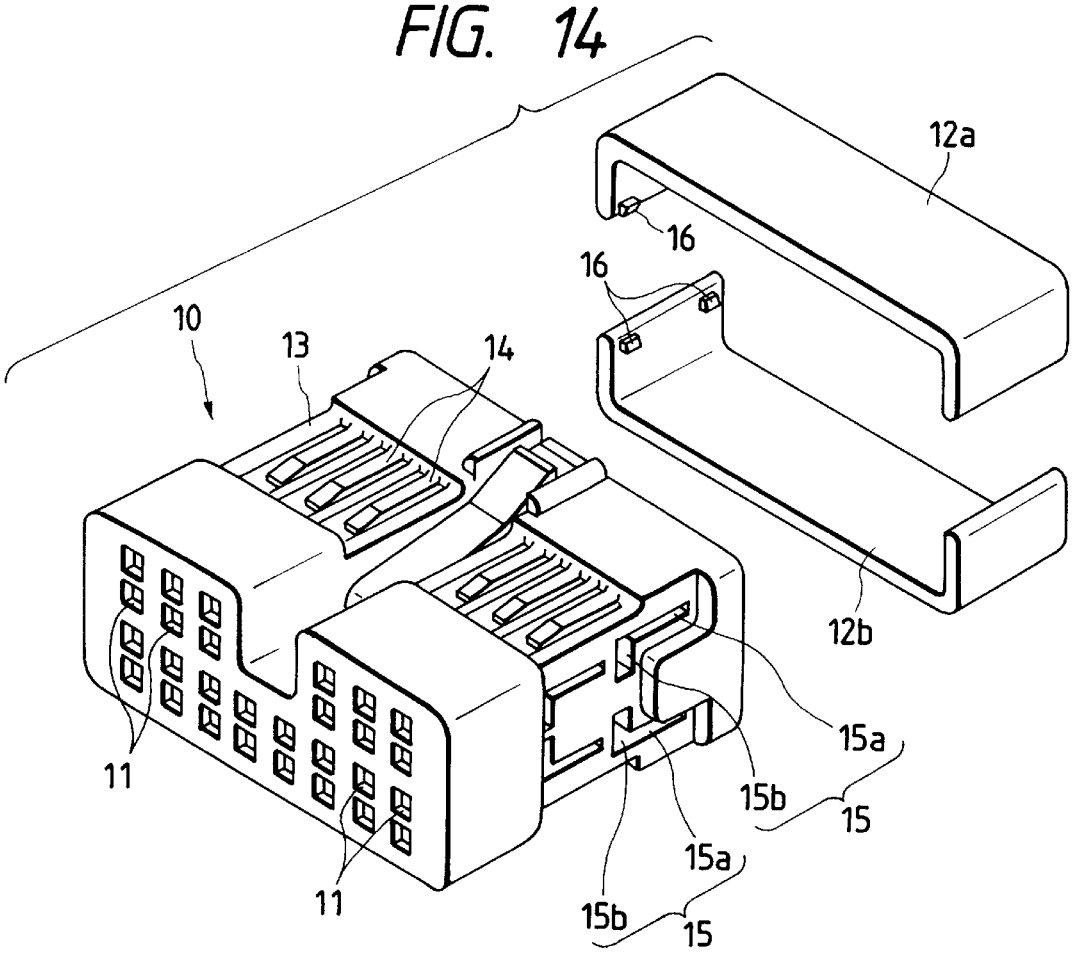
FIG. 14 is an exploded perspective view of first embodiment of the present invention.
Figure 15:
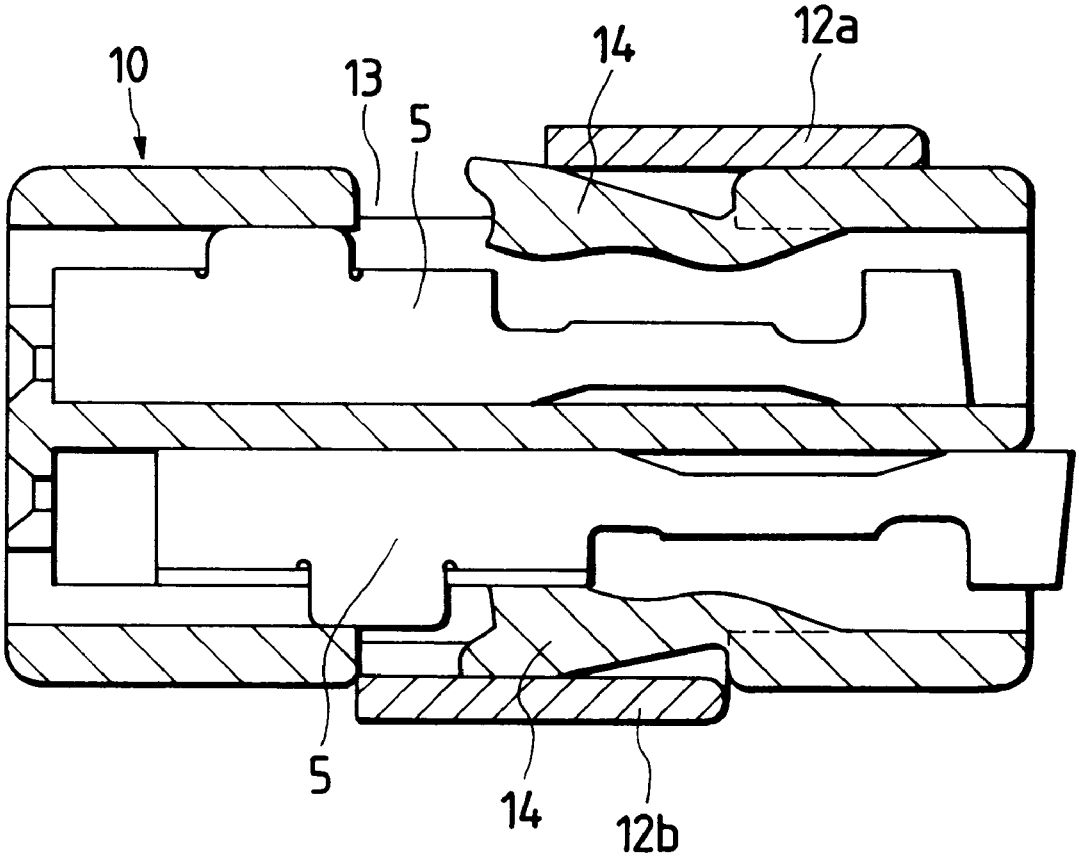
FIG. 15 is a sectional view of the connector of FIG. 14 showing the provisionally locking state and the formally locking state thereof.

FIGS. 14 and 15 show the connector of first embodiment. This connector is arranged in a manner that a pair of covers 12*a*, 12*b* are slid toward a housing 10 having a plurality of terminal storage chambers 11 thereby to cover the opening portion 13 of the housing 10. A locking arm 14 having elasticity is disposed in each of the terminal storage chambers 11 of the housing 10. The locking arm 14 is provided so as to be positioned at the opening portion 13 of the housing 10. When the locking arm 14 is bent, the locking arm engages with the terminal 5 within the terminal storage chamber 11, whereby the terminal 5 is prevented from being come out from the housing due to the engagement.

The covers 12*a*, 12*b* are arranged to slide between the provisionally locking position and the formally locking position with respect to the housing 10. To this end, the housing 10 is provided at side walls thereof with sliding grooves 15 and each of the covers 12*a*, 12*b* is provided with slide projections 16 sliding along the sliding grooves 15. Each of the sliding grooves 15 is formed by a horizontal portion 15*a* and a vertical portion 15*b* communicating to each other. When the slide projections 16 locate at the horizontal portions 15*a*, the covers 12*a*, 12*b* locate at the provisionally locking position, while when the slide projections locate at the vertical portions 15*b*, the covers 12*a*, 12*b* locate at the formally locking position.

When the covers 12*a*, 12*b* locate at the formally locking position, the covers 12*a*, 12*b* completely cover the opening portion 13.

As shown in FIG. 15, even if the cover 12*b* is tried to be shifted to the formally locking position in a state that the terminal 5 is incompletely inserted into the housing, since the locking arm 14 is bent toward the outside of the housing 10, the locking arm 14 prevents the cover 12*b* from moving to the formally locking position. Thus, the incomplete insertion state of the terminal 5 can be detected.

The cover 12*a* of FIG. 15 is located at the provisionally locking position. The attachment and detachment of the terminal 5 with respect to the housing 10 are performed in this state. In the provisionally locking position, a space in which the locking arm 14 is able to bend outside is formed between the cover 12*a* and the locking arm 14. Due to the presence of this space, the attachment and detachment of the terminal 5 is made possible. In other words, if the drawing jig is inserted into the housing through the opening portion 13 thereby to bend the locking arm 14 outside when the cover 12*a* locates at the provisionally locking position, the locking state of the locking arm 14 is released, whereby the terminal 5 can be detached.

Second Embodiment

Figure 1:
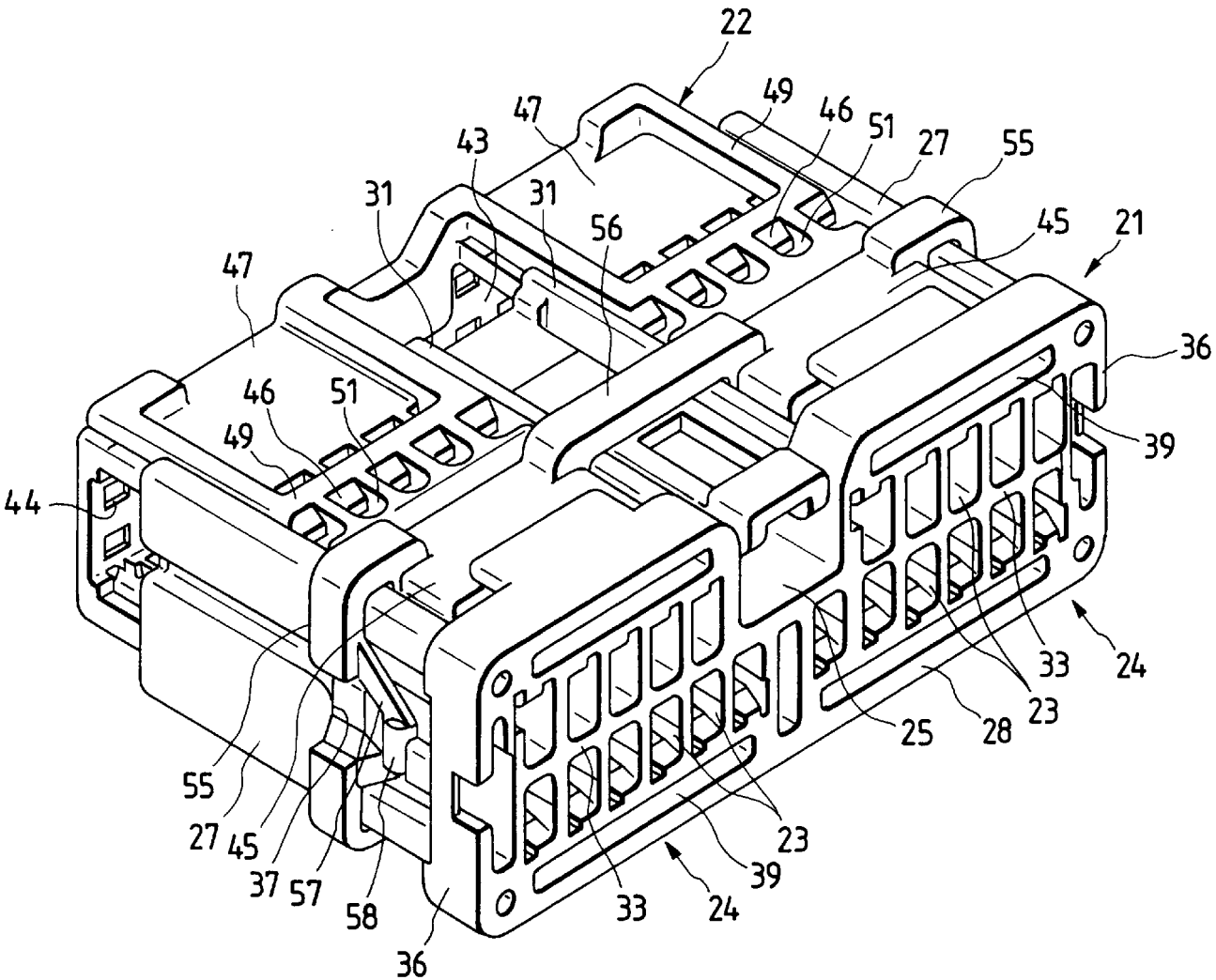
FIG. 1 is a perspective view of a connector according to second embodiment of the present invention showing the provisionally locking state of a front holder thereof seen from the rear side thereof.
Figure 2:
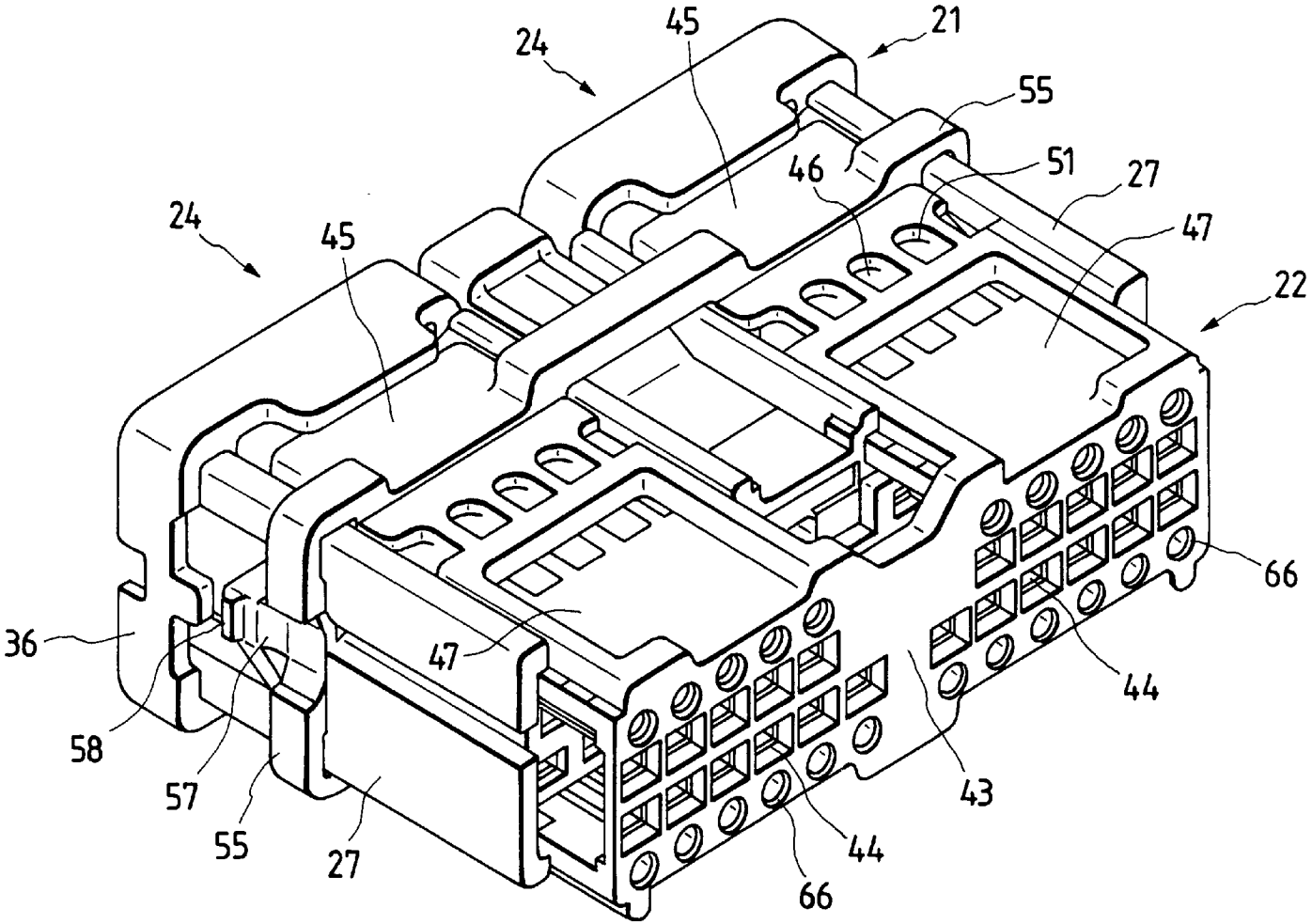
FIG. 2 is a perspective view of the front holder showing the provisionally locking state thereof seen from the front side thereof in the connector according to the embodiment of the present invention.
Figure 3:
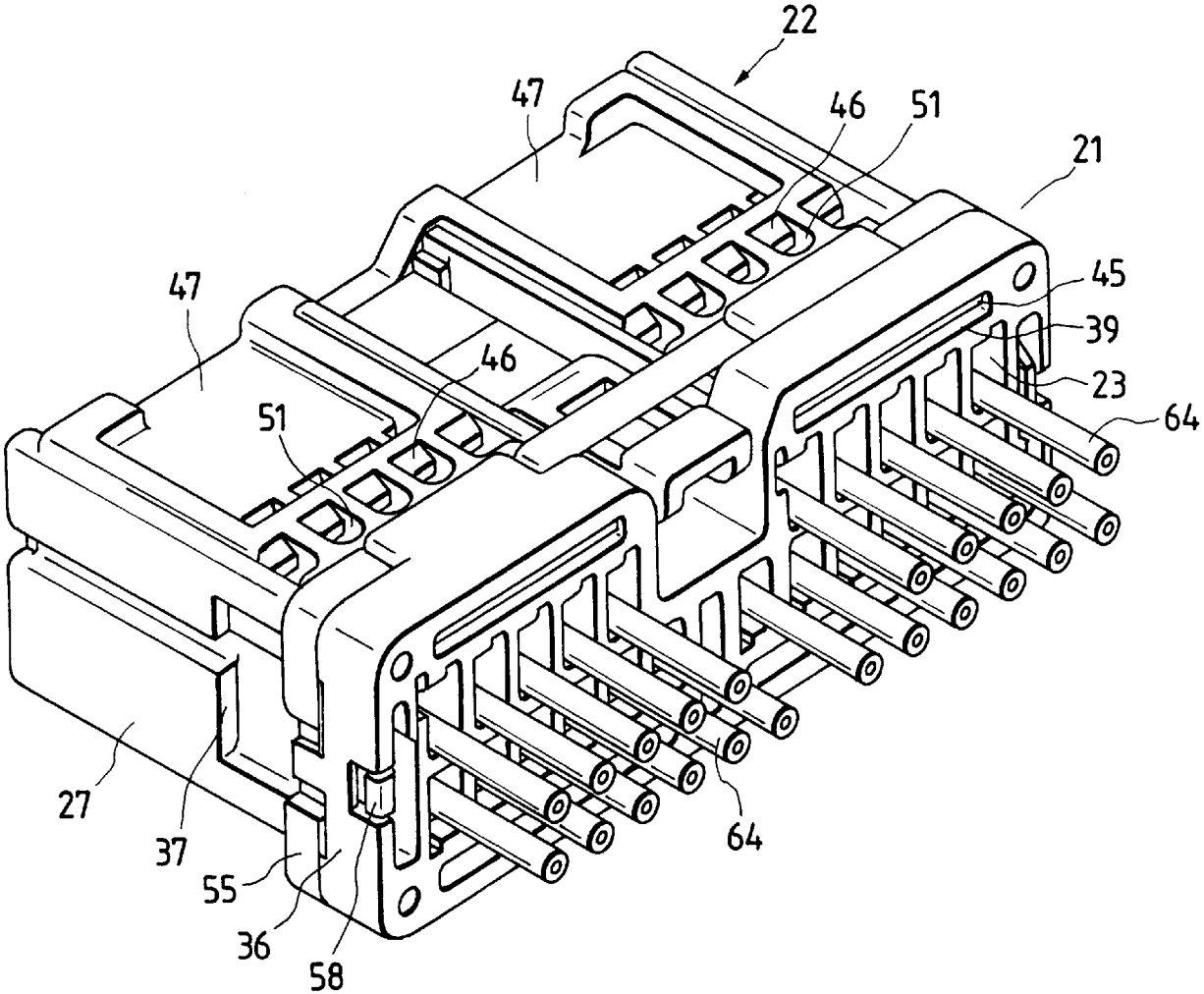
FIG. 3 is a perspective view of the connector according to the embodiment of the present invention showing the formally locking state of the front holder thereof seen from the rear side thereof.
Figure 4:
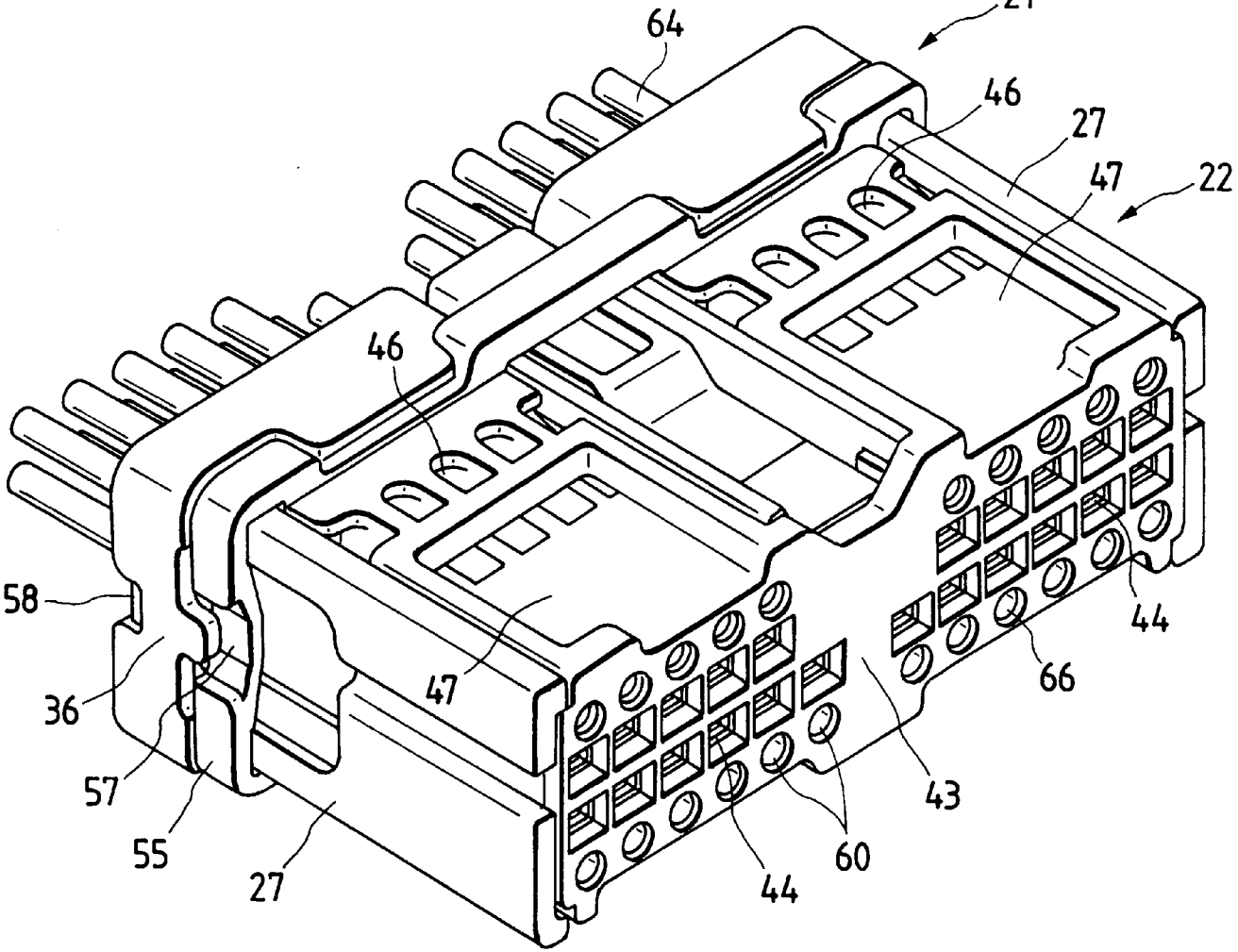
FIG. 4 is a perspective view of the front holder showing the formally locking state thereof seen from the front side thereof in the connector according to the embodiment of the present invention.
Figure 9:
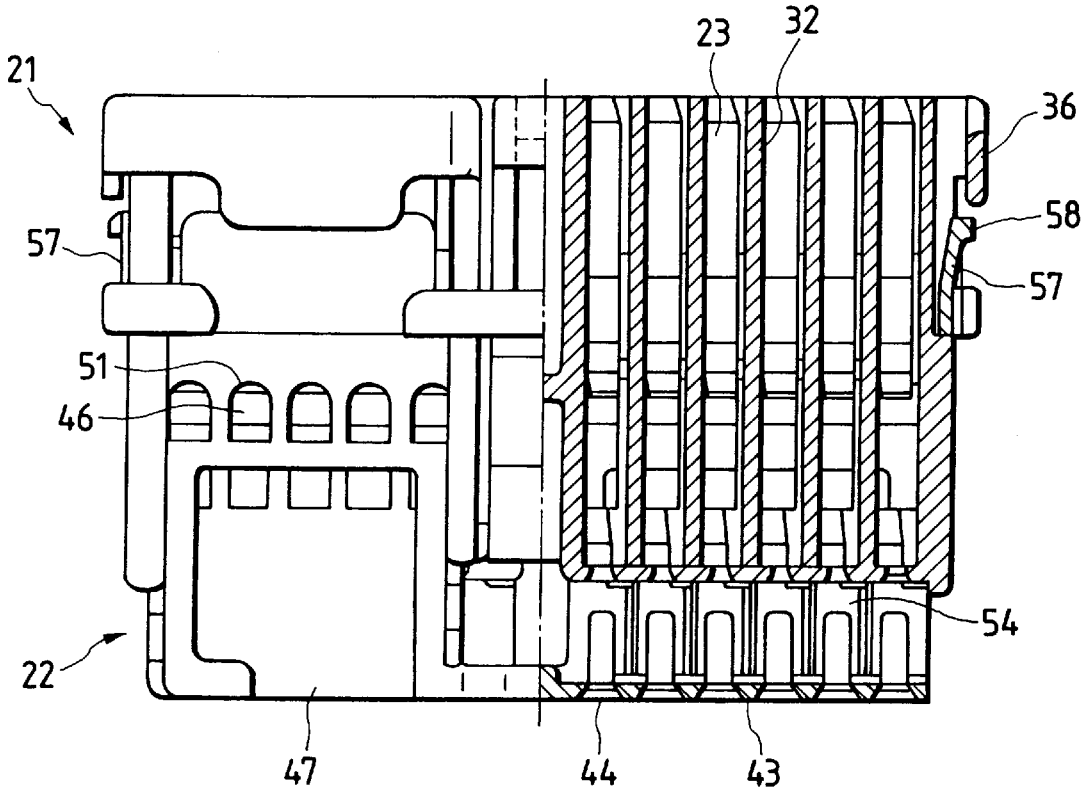
FIG. 9 is a partially cutaway plan view of the connector according to the embodiment of the present invention showing the provisionally locking state of the front holder thereof.

FIGS. 1, 2 and 9 show the state that a front holder 22 is positioned at the provisionally locking position with respect to a housing 21, while FIGS. 3 and 4 show the state that the front holder 22 is positioned at the formally locking position with respect to the housing 21. The connector according to the embodiment is formed by the housing 21 and the front holder 22.

Figure 5:
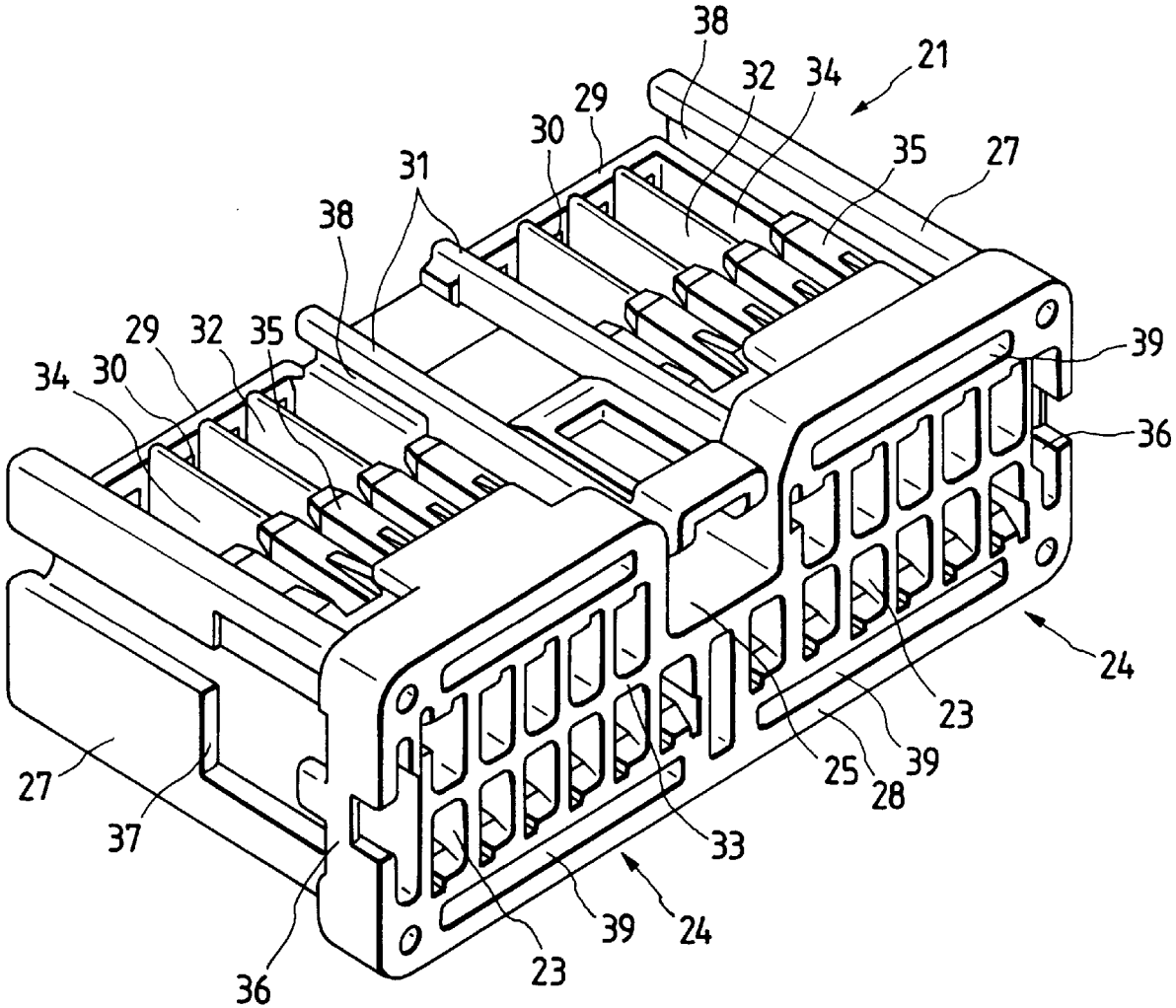
FIG. 5 is a perspective view of a housing seen from the rear side thereof in the connector according to the embodiment of the present invention.
Figure 6:
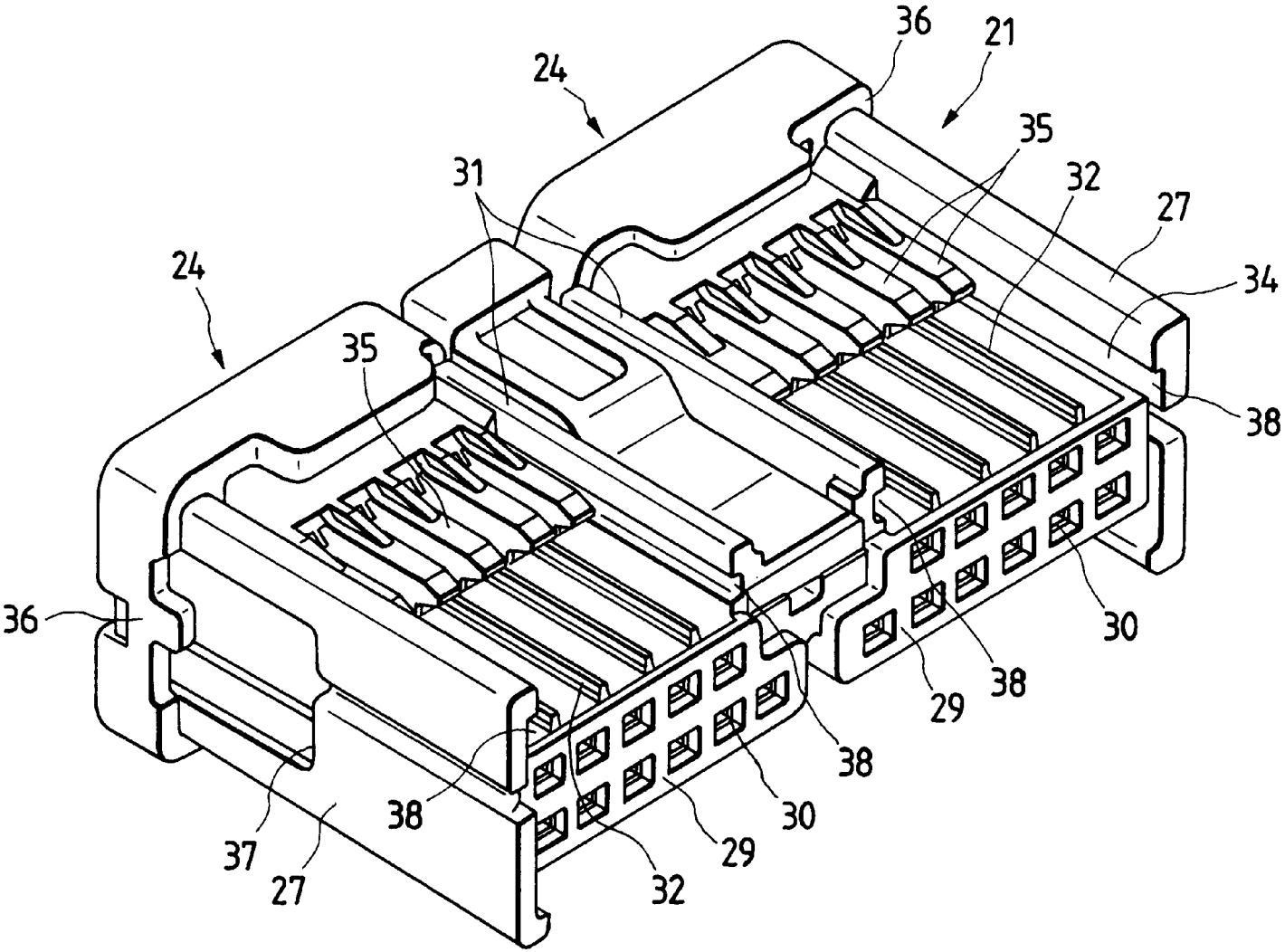
FIG. 6 is a perspective view of the housing seen from the front side thereof in the connector according to the embodiment of the present invention.

FIGS. 5 and 6 are diagrams showing the housing 21 seen from the rear and front sides thereof, respectively. The housing 21 includes left and right block bodies 24, 24 having terminal storage chambers 23 into which terminals 26 are inserted and further includes a coupling block 25 for coupling these left and right block bodies 24, 24. Each of the left and right block bodies includes five terminal storage chambers 23 aligned at the upper stage and six terminal storage chambers 23 aligned at the lower stage. The housing 21 further includes left and right outer side wall portions 27, 27 and inner side wall portions 31, 31 provided along the longitudinal direction of the left and right block bodies 24, 24, and furthermore includes a rear wall portion 28 for continuously coupling the left and right block bodies 24, 24 and the coupling block 25 at the rear side of the housing. The outer side wall portions 27, 27 and the rear wall portion 28 form the outer walls of the housing 21. The housing 21 is further provided with a front wall portion 29 at the front face side thereof. The front wall portion 29 is provided with communication holes 30 being opened and respectively corresponding to the terminal storage chambers 23.

The terminal storage chambers 23 of the block bodies 24, 24 are independently separated by partitioning wall portions 32 each for partitioning the terminal storage chambers 23 disposed adjacently to the horizontal direction together with an intermediate wall portion 33 for partitioning the block bodies 24, 24 into upper and lower sections, so that the terminals 26 inserted into the adjacent terminal storage chambers 23 are prevented from contacting to each other. The upper and lower face portions of the block bodies 24, 24 are opened to form opened portions 34 which are covered by the front holder 22 described later.

Each of the terminal storage chambers 23 is provided with a locking arm 35. The locking arm 35 extends from the rear wall portion 28 to the forward side and the tip portion thereof is formed to be a free end, so that the locking arm has elasticity capable of being bent and deformed. The locking arm 35 engages with the terminal 26 inserted into the terminal storage chamber 23 thereby to prevent the terminal 26 from coming out to the rear side of the housing 21.

Further, a locking frame 36 is formed at each of the left and right end portions of the rear wall portion 28 of the housing 21. Each of the locking frames 36 is arranged to form a closed loop. The front holder 22 is fixed at the formally locking position when the front holder 22 engages with the locking frames 36.

In contrast, at a portion of the outer side wall portion 27 of the housing 21 in the front side of each of the locking frames 36, an abutment portion 37 is formed which protrudes in a step-fashion to the outside. The abutment portion 37 fixes the front holder 22 at the provisionally locking position thereby to prevent the front holder 22 from being drawn back from the provisionally locking position. Guide grooves 38 for guiding the sliding operation of the front holder 22 are formed at the outer side wall portions 27 and the inner side wall portions 31. Further, at each of the upper and lower portions of the rear wall portion 28, insertion holes 39 are formed into which the tip portions of the excessive deformation prevention plates 45 of the front holder 22 are slidably inserted.

Figure 7:
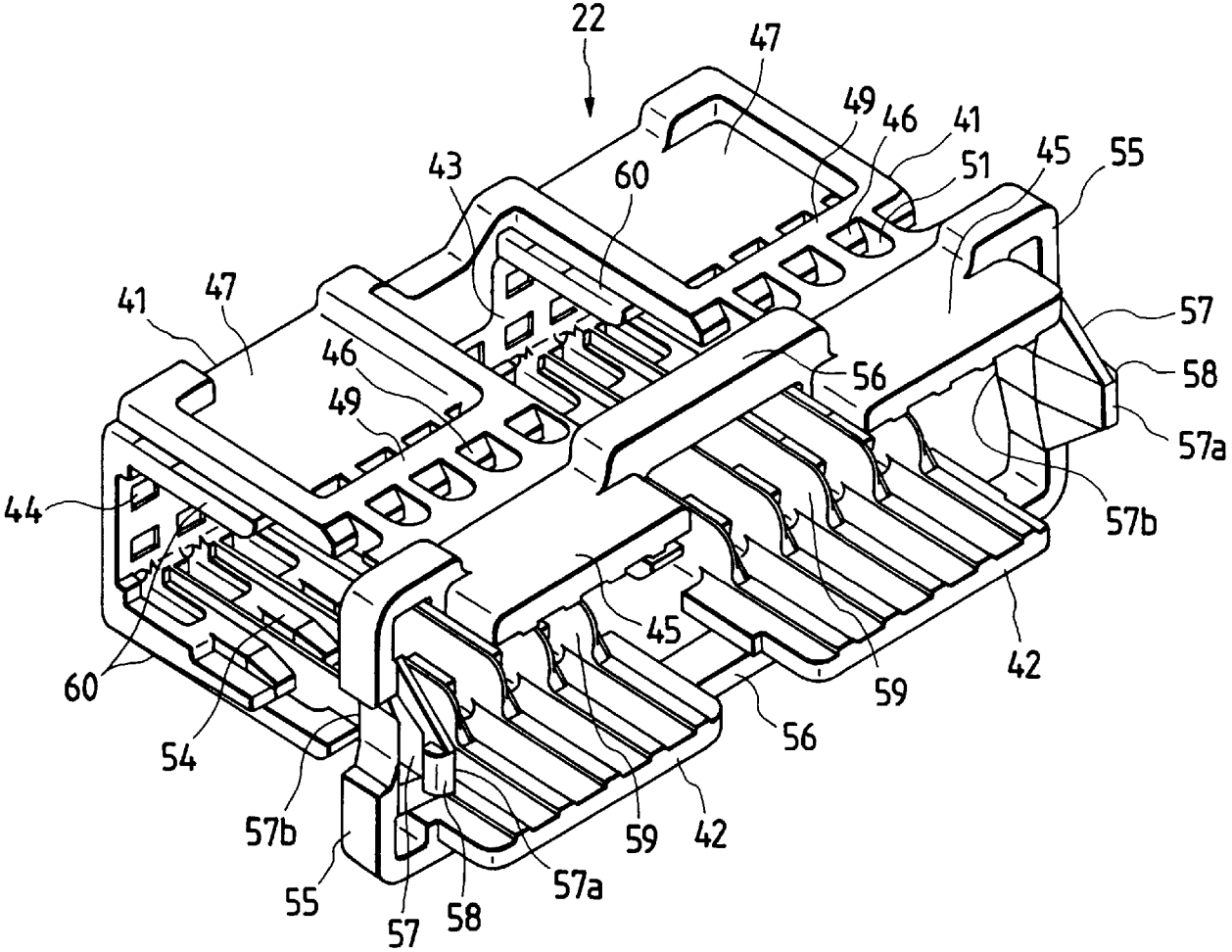
FIG. 7 is a perspective view of the front holder seen from the rear side thereof in the connector according to the embodiment of the present invention.
Figure 8:
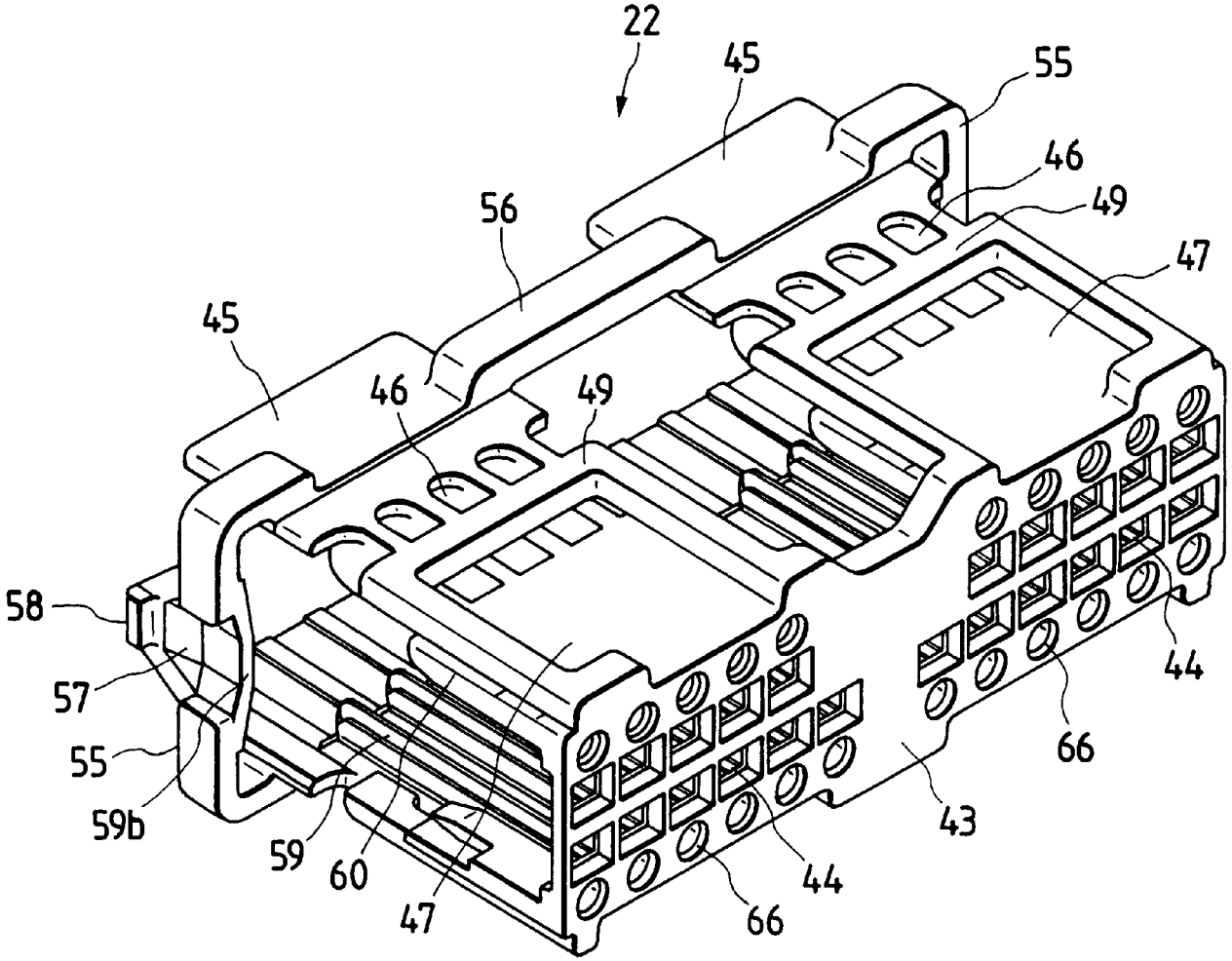
FIG. 8 is a perspective view of the front holder seen from the front side thereof in the connector according to the embodiment of the present invention.

FIGS. 7 and 8 show the front holder 22 seen from the rear side and the front side, respectively. The front holder 22 includes upper wall portions 41 and lower wall portions 42 disposed in parallel, and further includes a front wall portion 43 extending vertically and coupling at the front face side these upper and lower wall portions 41, 42. The front holder 22 is opened at the left and right side faces and the rear face thereof, so that the front holder is formed in a ⊐-shape when seen from the side wall side thereof. In this case, the upper wall portions 41 and the lower wall portions 42 serve to cover the upper and lower opened portions 34 of the block bodies 24 of the housing 21. To this end, left and right upper wall portions 41 and the left and right lower wall portions 42 are provided in correspondence with the left and right block bodies 24 of the housing 21, respectively.

In the state where the front holder 22 is attached to the housing 21, partner-side terminals (not shown) are inserted into the terminal storage chambers 23 from the front wall portion 43 of the front holder 22. To this end, the front wall portion 43 is provided with terminal insertion holes 44 which are opened and respectively corresponding to the terminal storage chambers 23 of the housing 21. As shown in FIGS. 2 and 8, detection pin insertion holes 66 are formed in the vicinity of the terminal insertion holes 44, respectively. A detection pin (not shown) for performing the conduction inspection or the like of the terminal 26 is inserted into the detection pin insertion hole 66.

Each of the upper and lower wall portions 41, 42 is formed by sequentially and continuously providing the excessive deformation prevention plate 45, detection plate 46 and terminal pressing plate 47.

Figure 10:
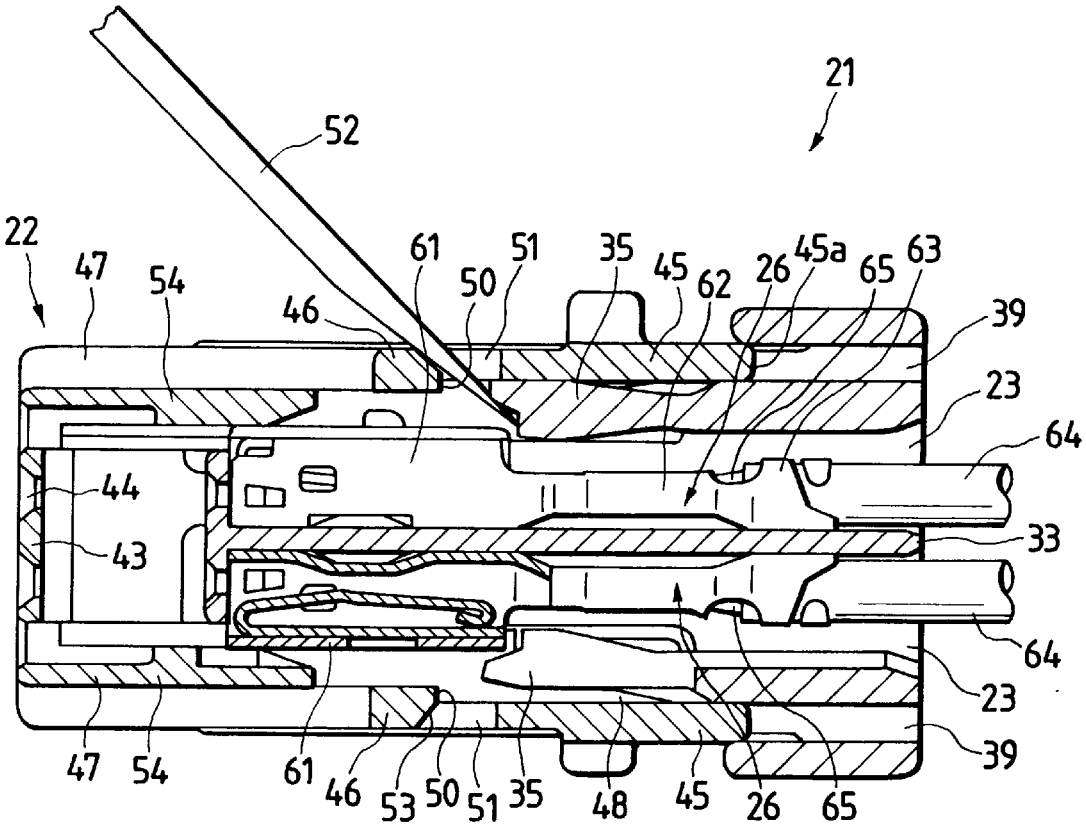
FIG. 10 is a longitudinal sectional view of the connector according to the embodiment of the present invention showing the provisionally locking state of the front holder thereof.

The excessive deformation prevention plates 45 are positioned at the housing 21 side of the front holder, that is, the most rear side of the front holder. The excessive deformation prevention plates 45 serve to prevent the excessive deformation of locking arms 35 of the housing 21. FIG. 10 shows a state where the front holder 22 is stopped at the provisionally locking position. When the front holder 22 locates at the provisionally locking position, the excessive deformation prevention plates 45 are in a state of covering the outside of the locking arms 35 of the housing 21. In this case, the excessive deformation prevention plates 45 covers the locking arms 35 in a manner that a bending deformation space 48 is formed between the excessive deformation prevention plates 45 and the locking arms 35, whereby the locking arms 35 can be bent and deformed outside.

According to such a provisionally locking position of the front holder 22, the engagement of the locking arm 35 with the terminal 26 can be released by bending the locking arm 35 outside as described later. In this case, since the excessive deformation prevention plates 45 covers the locking arm 35 from the outside, the locking arm 35 is prevented from being deformed excessively more than needed even if an excessive stress is applied to the locking arms 35. Accordingly, the locking arms 35 are prevented from being subjected to the plastic deformation or breakage due to the excessive deformation thereof.

The tip portion side 45*a* of each of the excessive deformation prevention plates 45 is formed to be a free end. The excessive deformation prevention plates 45 is supported at the tip portion side 45*a* thereof by being inserted at the tip portion side 45*a* thereof into an insertion hole 39 formed at the rear wall portion 28 of the housing 21. Such a supporting of the excessive deformation prevention plates 45 by the insertion holes 39 is performed when the front holder 22 is located at the provisionally locking position and continued when the front holder is slid to the formally locking position.

The detection plates 46 are provided between the excessive deformation prevention plates 45 and the terminal pressing plates 47. In this embodiment, each of the upper wall portions 41 and the lower wall portions 42 is provided with a rib 49 which protrudes in a step-fashion from the terminal pressing plate 47. Each of the detection plates 46 is formed so as to protrude from the rib 49 toward the excessive deformation prevention plate 45. The detection plates 46 are formed to protruded from the rib 49 in this manner so as to correspond to the terminal storage chambers 23 of the housing 21, respectively.

The detection plates 46 are integrally formed with the excessive deformation prevention plate 45, and the detection plates 46 protrude towards the locking arms 35 of the housing 21 relative to the excessive deformation prevention plate 45, as shown in FIG. 10. That is, the detection plate 46 has a step portion 50 protruding to the locking arm 35 side relative to the excessive deformation prevention plate 45, whereby it can be detected by the presence of the step portion 50 whether or not the terminal 26 is completely inserted into the terminal storage chamber 23. This detection is performed depending on whether or not the detection plate 46 abuts against the locking arm 35.

An opening window portion 51 is formed between the detection plate 46 and the excessive deformation prevention plate 45 so that the drawing jig 52 can be inserted within the housing through the opening window portion 51. A tapered surface 53 slanted towards the locking arm 35 is formed on the surface of the detection plate 46 facing on the opening window portion 51. This tapered surface 53 serves to guide therealong the drawing jig 52 which is inserted within the housing, so that the drawing jig 52 can be inserted smoothly.

The terminal pressing plate 47 protrudes within the housing 21 in a manner that it locates at a lower position than the detection plate 46. Pressing projections 54 are respectively formed in correspondence with the terminal storage chambers 23 on the housing 21 side of each of the terminal pressing plates 47. The pressing projection 54 acts to press the terminal 26 towards the terminal storage chamber 23, that is, towards the intermediate wall portion 33 (see FIG. 5), whereby the terminal 26 can be fixed without wobbling.

Guide ribs 60 are formed at both sides of the terminal pressing plate 47 in each of the upper and lower wall portions 41, 42. Guide grooves 38 into which the guide ribs 60 are slidably inserted are formed in the housing 21. The tip side of each of the guide ribs 60 inclines toward the direction away from the terminal pressing if plate 47 and laps on the guide groove 38. Thus,the wobbling between the front holder 22 and the housing 21 can be prevented by sliding the guide ribs 60 along the guide grooves 38. As a result, there does not appear more clearance than needed between the terminals 26 and the terminal pressing plate 47 (that is, a clearance necessary for performing good contact between male and female terminals) and so the tip portions of the terminals 26 are prevented from being exposed from the insertion holes 39.

The excessive deformation prevention plates 45 of the upper and lower wall portions 41, 42 are coupled by a sliding arm 55 and also the excessive deformation prevention plates 45 disposed adjacently to the longitudinal or horizontal direction are coupled by a coupling arm 56. Since each of the excessive deformation prevention plates 45 is coupled in the longitudinal and horizontal direction in this manner, the excessive deformation prevention plates 45 are provided with sufficient intensity and hence can be prevented from being deformed easily.

A locking arm 57 is integrally formed with the sliding arm 55 at the center portion thereof. The locking arm 57 is formed in a trapezoidal-shape when seen form the side wall side and the top side portion 57*a* thereof protrudes on the housing 21 side. A locking projection 58 for engaging with the locking frame 36 of the housing 21 is formed on the top side portion 57*a*. The locking projection 58 engages with the locking frame 36 when the front holder 22 slides to the formally locking position, where by the front holder 22 can be fixed at the formally locking position according to this engagement.

The bottom side portion of the locking arm 57 serves as a stopper portion 57*b* which abuts against the abutment portion 37 formed at the outer side wall portion 27 of the housing 21. According to such an abutment of the stopper portion 57*b* against the abutment portion 37, the front holder 22 is prevented from being returned from the provisionally locking position.

Further, guide ribs 60 are formed at both sides of the terminal pressing plate 47 in each of the upper and lower wall portions. The respective guide ribs 60 slide along the guide grooves 38 of the housing 21, so that the front holder 22 slides stably. On the housing 21 side of the upper and lower wall portions 41, 42, partitioning plate portions 59 are provided to extend vertically with respect to the upper and lower wall portions in correspondence with the partitioning wall portions 32 of the housing 21, respectively, whereby the terminal storage chambers 23 are partitioned by the partitioning plate portions 59 together with the partitioning wall portions 32.

The terminals 26 are formed by subjecting a conductive metal plate to the punching pressing process. As shown in FIG. 10, each of the terminals 26 includes a contact portion 61, a connection portion 62 and a caulking portion 63 along the longitudinal direction thereof. The contact portion 61 serves to perform electrical conduction to the partner-side terminal when the partner-side terminal is inserted and contacts to the contact portion 61. The connection portion 62 serves to connect the terminal to a covered wire 64 when caulks the core wire 65 of the covered wire 64. The caulking portion 63 serves to fix the covered wire 64 when caulks the covered wire 64. In this embodiment, the aforesaid locking arm 35 engages with the rear side of the contact portion 61.

Then, the assembling operation of the connector according to the embodiment will be explained. The outer side wall portions 27 of the housing 21 are inserted into the sliding arms 55 of the front holder 22, then the front holder 22 is slid to the rear side. According to this sliding operation, the front holder 22 can be assembled at the provisionally locking position with respect to the housing 21, as shown in FIGS. 1, 2 and 9. In this state, the terminals 26 connected to the covered wires 64 are inserted into the terminal storage chambers 23 from the rear side.

After the insertion of the terminals 26, the front holder 22 is slid to the rear side thereby to engage the locking arms 57 with the locking frames 36 of the housing 21. According to this sliding operation and this engagement with the locking frame 36, the front holder 22 is fixed at the formally locking position as shown in FIGS. 3 and 4.

Figure 11:
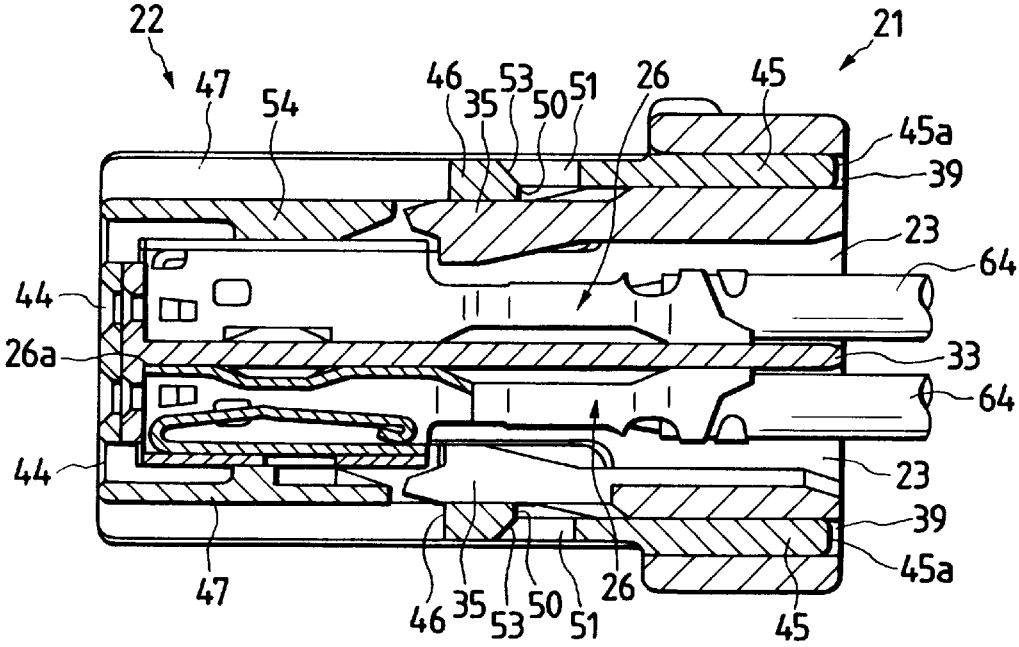
FIG. 11 is a longitudinal sectional view of the connector according to the embodiment of the present invention showing the formally locking state of the front holder thereof.
Figure 12:
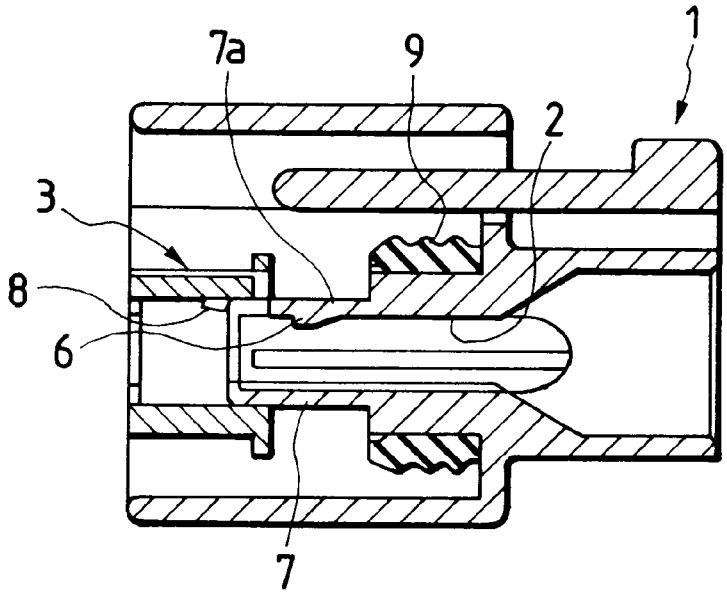
FIG. 12 is a sectional view of a conventional connector showing the provisionally locking state thereof.
Figure 13:
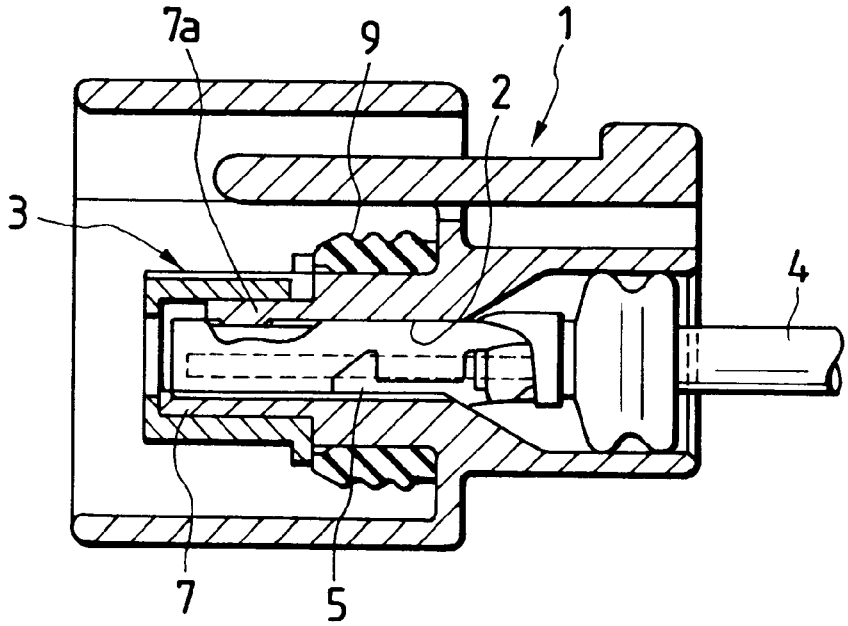
FIG. 13 is a sectional view of the conventional connector of FIG. 12 showing the formally locking state thereof.

In the state where the front holder 22 is fixed at the formally locking position in this manner, as shown in FIG. 11, the communicating holes 30 of the housing 21 communicate with the terminal insertion holes 44 of the front holder 22. Thus, the partner-side terminals (not shown) can proceed into the terminal storage chambers 23, so that it becomes possible to connect the partner-side terminals with the terminals 26.

In the sliding operation of the front holder to the formally locking position, in the case where the terminal 26 is completely inserted into the terminal storage chamber, the locking arm 35 engages with the rear side of the contact portion 61 of the terminal 26 and so is prevented from being deformed outside, so that the detection plate 46 makes the locking arm 35 slide smoothly. Each of the detection plates 46 has the step portion 50 and protrudes towards the corresponding locking arm 35, so that the detection plates 46 occupy the bending deformation spaces of the locking arms 35, as shown in FIG. 11. The detection plates 46 may be arranged in a manner that the bottom walls thereof press the locking arms 35 from the outside. Accordingly, since the locking arms 35 can not be come out from the locking state with the terminals 26, the terminals 26 can be surely fixed within the terminal storage chambers 23.

In contrast, when the terminal 26 is in a incomplete insertion state such as a semi-insertion state into the terminal storage chamber, the locking arm 35 can not engage with the contact portion 61 of the terminal 26 in a good condition and so the locking arm 35 deviates outside. In this state, since the detection plate 46 having the step portion 50 and protruding towards the corresponding locking arm 35 abuts against the locking arm 35, the front holder 22 can not be slid. Accordingly, the incomplete insertion of the terminal 26 can be detected. Further, according to this embodiment, since the tapered surface 53 is formed on the detection plate 46 so that the tapered surface 53 picks up the locking arm 35 which is deformed outside, it becomes impossible to forcedly push in the front holder 22. Accordingly, the front holder 22 can be prevented from being attached to the housing 21 due to the forcedly push-in operation.

According to such a structure of this embodiment, since the detection plate 46 has the step portion 50 to protrude therefrom, the aforesaid function can be performed by merely sliding the front holder 22 toward the horizontal direction. Thus, the front holder 22 is not required to be slid toward both the horizontal and vertical direction. Accordingly, the connector can be simplified in its structure for sliding and the thickness thereof can be made smaller. Further, since the front holder is required to be slid only to one direction, the operability of the connector can be improved and the connector can be adapted to the automation system.

Then, in the case of extracting the terminal 26 from the connector in the aforesaid state, the engagement state between the locking frame 36 and the locking arm 57 is released, and then the front holder 22 is slid and restored to the provisionally locking position. In this provisionally locking position, since the excessive deformation prevention plate 45 covers the locking arms 35 from the outside so as to have the bending deformation space 48 therebetween as shown in FIG. 10, it is possible to insert the drawing jig 52 into the space through the opening window portion 51 to bend the locking arm 35 outside. When the locking arm 35 is bent in this manner, the locking arm 35 can be released from the engagement state with the terminal 26. As a result, the terminal 26 can be extracted from the housing 21.

In this case, since the excessive deformation prevention plate 45 covers the locking arms 35, the excessive deformation of the locking arms 35 can be prevented. Thus, the locking arms 35 are prevented from being bent excessively even if an excessive stress is applied to the locking arms 35, so that the locking arms 35 are prevented from being subjected to the plastic deformation or breakage.

At the time of inserting such a drawing jig 52, the drawing jig 52 can be guided within the housing by sliding the drawing jig 52 along the tapered surface 53 formed on the detection plate 46. Thus, the drawing jig 52 can be surely and easily inserted within the housing.

As described above, according to the present invention, when the front holder locates at the provisionally locking position, the excessive deformation prevention plate covers the outside of the locking arm in a state that a bending deformation space for the locking arm is formed therebetween thereby to prevent the excessive deformation of the locking arm. Accordingly, the locking arm is prevented from being bent to the more extent than needed even if an excessive stress is applied to the locking arm, whereby the locking arm is prevented from being subjected to the plastic deformation or breakage. Further, since the detection plate has the step portion protruding to the locking arm side relative to the excessive deformation prevention plate, the complete insertion of the terminal can be detected by merely sliding the front holder to the horizontal direction.

According to such a structure of this invention, the structure of the connector for sliding is required to merely slide the front holder to the horizontal direction. Accordingly, the connector can be simplified in its structure for sliding and the thickness thereof can be made smaller. Further, the operability of the connector can be improved and the connector can be adapted to the automation system.

According to the present invention, since the detection plate engages with the locking arm when the front holder locates at the formally locking position, the locking arm is prevented from being released from the engagement state with the terminal. Accordingly, the terminal can be surely locked.

According to the present invention, since the drawing jig can be inserted within the housing through the opening window portion thereby to easily bend the locking arm outside, the terminal can be extracted easily.

According to the present invention, since the drawing jig can be guided within the housing by sliding the drawing jig along the tapered surface of the detection plate, the drawing jig can be inserted easily and surely. Further, since the tapered surface of the detection plate picks up the locking arm which is deformed outside due to the incomplete insertion of the terminal, it becomes impossible to forcedly push in the front holder. Accordingly, the front holder can be prevented from being attached to the housing due to the forcedly push-in operation.

What is claimed is:

1. A connector comprising:

a locking arm engaged with a terminal which is inserted within a terminal storage chamber of a housing to prevent said terminal from being removed from said housing;

a front holder slid from a front face side of said housing to move from a provisionally locking position to a formally locking position so that a detection plate of said front holder detects complete insertion of said terminal into said terminal storage chamber; and an excessive deformation prevention plate integrally formed at a tip portion side of said detection plate in a manner that, when said front holder is located at said provisionally locking position, said excessive deformation prevention plate covers an outside of said locking arm so as to define a bending deformation space for said locking arm therebetween and prevents excessive deformation of said locking arm toward a direction for releasing an engagement with said terminal, and said detection plate having a step portion protruding to said locking arm side relative to said excessive deformation prevention plate.

2. A connector according to claim 1, wherein said detection plate prevents said locking arm from being bent when said front holder is located at said formally locking position.

3. A connector according to claim 1, wherein an opening window portion is provided between said excessive deformation prevention plate and said detection plate.

4. A connector according to claim 3, wherein a surface of said detection plate facing on said opening window portion is formed as a tapered surface.

5. A connector comprising:

a housing having a plurality of terminal storage chambers;

a locking arm for fitting a terminal within each of said terminal storage chambers;

a front holder slidingly movable with respect to said housing between a provisionally locking position and a formally locking position;

a detecting plate detecting complete insertion of said terminal into said terminal storage chamber, said detecting plate formed on said front holder;

an excessive deformation prevention plate integrally formed at a tip portion side of said detection plate in such a manner that when said front holder is located at said provisionally locking position, said excessive deformation prevention plate covers an outside of said locking arm so as to define a bending deformation space for said locking arm therebetween and prevents excessive deformation of said locking arm toward a direction for releasing an engagement with said terminal; and a step portion, formed on said detection plate, protruding to said locking arm side relative to said excessive deformation prevention plate.

6. A connector according to claim 5, wherein an opening window portion is provided between said excessive deformation prevention plate and said detection plate.

* * * * *